US008167540B2

(12) United States Patent
Schlinker et al.

(10) Patent No.: US 8,167,540 B2
(45) Date of Patent: May 1, 2012

(54) SYSTEM FOR REDUCING COMPRESSOR NOISE

(75) Inventors: Robert Hans Schlinker, Canton, CT (US); James C. Napier, San Diego, CA (US); David R. Polak, Glastonbury, CT (US); Ray-Sing Lin, Glastonbury, CT (US); Scott A. Liljenberg, Wethersfield, CT (US); Anthony C. Jones, San Diego, CA (US)

(73) Assignee: Hamilton Sundstrand Corporation, Rockford, IL (US)

( * ) Notice: Subject to any disclaimer, the term of this patent is extended or adjusted under 35 U.S.C. 154(b) by 1366 days.

(21) Appl. No.: 12/011,822

(22) Filed: Jan. 30, 2008

(65) Prior Publication Data

US 2009/0191047 A1 Jul. 30, 2009

(51) Int. Cl.
*F01D 25/06* (2006.01)

(52) U.S. Cl. ..... 415/119; 416/185; 416/203; 416/238; 416/241 R; 416/500

(58) Field of Classification Search ..... 415/119; 416/203, 238, 241 R, 500
See application file for complete search history.

(56) References Cited

U.S. PATENT DOCUMENTS

| | | | | |
|---|---|---|---|---|
| 4,012,172 | A | 3/1977 | Schwaar et al. | |
| 4,370,560 | A | 1/1983 | Faulkner et al. | |
| 4,627,234 | A | 12/1986 | Schuh | |
| 4,732,532 | A | 3/1988 | Schwaller et al. | |
| 4,815,277 | A | 3/1989 | Vershure, Jr. et al. | |
| 4,834,622 | A | 5/1989 | Schuh | |
| 4,916,893 | A | 4/1990 | Rodgers | |
| 5,140,819 | A | 8/1992 | Napier et al. | |
| 5,491,308 | A | 2/1996 | Napier et al. | |
| 5,681,145 | A | 10/1997 | Neely et al. | |
| 6,379,112 | B1 * | 4/2002 | Montgomery | 415/119 |
| 6,471,482 | B2 * | 10/2002 | Montgomery et al. | 416/203 |
| 6,904,949 | B2 * | 6/2005 | Decker et al. | 164/35 |
| 7,014,144 | B2 | 3/2006 | Hein et al. | |
| 7,500,299 | B2 * | 3/2009 | Dupeux et al. | 29/407.07 |
| 7,789,627 | B2 * | 9/2010 | Chiang et al. | 416/144 |
| 2006/0029493 | A1 | 2/2006 | Schwaller et al. | |

* cited by examiner

*Primary Examiner* — Ninh H Nguyen
(74) *Attorney, Agent, or Firm* — Kinney & Lange, P.A.

(57) ABSTRACT

A system for reducing compressor noise includes a rotor having a plurality of blades. The blades have a nominal geometry characterized by a blade parameter. At least some of the blades are mistuned, such that they differ from the nominal geometry by greater than a manufacturing tolerance in the blade parameter. The blades produce shock waves at a blade passing frequency, and the mistuned blades shift acoustic energy away from the blade passing frequency to multiple lower amplitude tones at other frequencies. The system is configurable to be deployed with an inlet silencer that preferentially absorbs acoustic energy at some of the shifted frequencies.

21 Claims, 7 Drawing Sheets

SYSTEM FOR REDUCING COMPRESSOR NOISE

BACKGROUND

This invention relates generally to the reduction of compressor noise. One possible application of the system is for gas turbine engines, and in particular auxiliary power units.

Auxiliary power units (APUs) were originally designed to meet aviation power needs during ground operations, when the main engines are not running. APUs provide power for electrical and instrumentation systems, hydraulic systems, and main engine startup, and supply cabin air to the environmental control system. Increasingly, APUs are also configured for in-flight functionality, both as a standalone source of accessory power and cabin air, independent of the main engines, and as an emergency backup in the event of main engine failure.

APUs for commercial and military aircraft are typically designed around a gas turbine engine. The gas turbine engine includes a compressor, a combustor and a turbine, arranged in flow series. The compressor and turbine are rotary devices, each with a number of blades oriented radially around a rotor hub or spinner. The compressor supercharges the combustor and, in some configurations, provides pressurized air for the environmental control system and/or various pneumatic accessories. The combustor ignites a fuel-air mixture to produce hot combustion gases, which drive the turbine. The turbine drives the compressor, and delivers rotational energy to an electrical generator, pumps, or other mechanical accessories.

Gas turbine engine compressors rotate at high speeds, and in some designs the blade tips approach supersonic velocity. The result is a series of shock waves generated at the blade passing frequency (BPF), where the BPF is a "pure tone" frequency at which compressor blades pass a given fixed point in space, and which exceeds the broadband noise portion of the acoustic spectrum. As shock waves propagate from the near field at the compressor face into the far field inside the inlet duct, they degenerate into a multi-tone sound spectrum characterized as "buzz saw" noise. The multiple tones occur at engine shaft harmonic frequencies, representing a redistribution (or shift) of acoustic energy away from the single BPF frequency into multiple frequency tones. The resulting sound quality has a characteristically annoying sound quality, and buzz saw noise can be an environmental concern. Turbine inlet silencers have been developed to reduce this component of compressor noise, but there remains an ongoing need for new techniques that complement and enhance this approach.

SUMMARY

A system for reducing compressor noise includes a compressor rotor having a plurality of blades. The blades have a nominal blade geometry characterized by blade parameters including pitch, axial sweep, lean angle, cutback and other parameters. At least some of the blades are mistuned, such that they differ from the nominal blade geometry by greater than the manufacturing tolerance in at least one blade parameter. Mistuning distinguishes from previous designs in which the goal is to achieve blade uniformity by reducing differences in the parameters to below manufacturing tolerances.

When the compressor blades rotate, they produce shock waves at the blade passing frequency. The shock waves generate a frequency-dependent noise intensity spectrum. The mistuned blades reduce noise intensity at the blade passing frequency by shifting acoustic energy to multiple lower-amplitude tones. The lower-amplitude tones are harmonic frequencies of the engine's rotational speed. This alters subjective response to the compressor noise. The system is also configurable to be deployed with an inlet silencer that preferentially absorbs some of the shifted tones.

DETAILED DESCRIPTION

Figure 1:
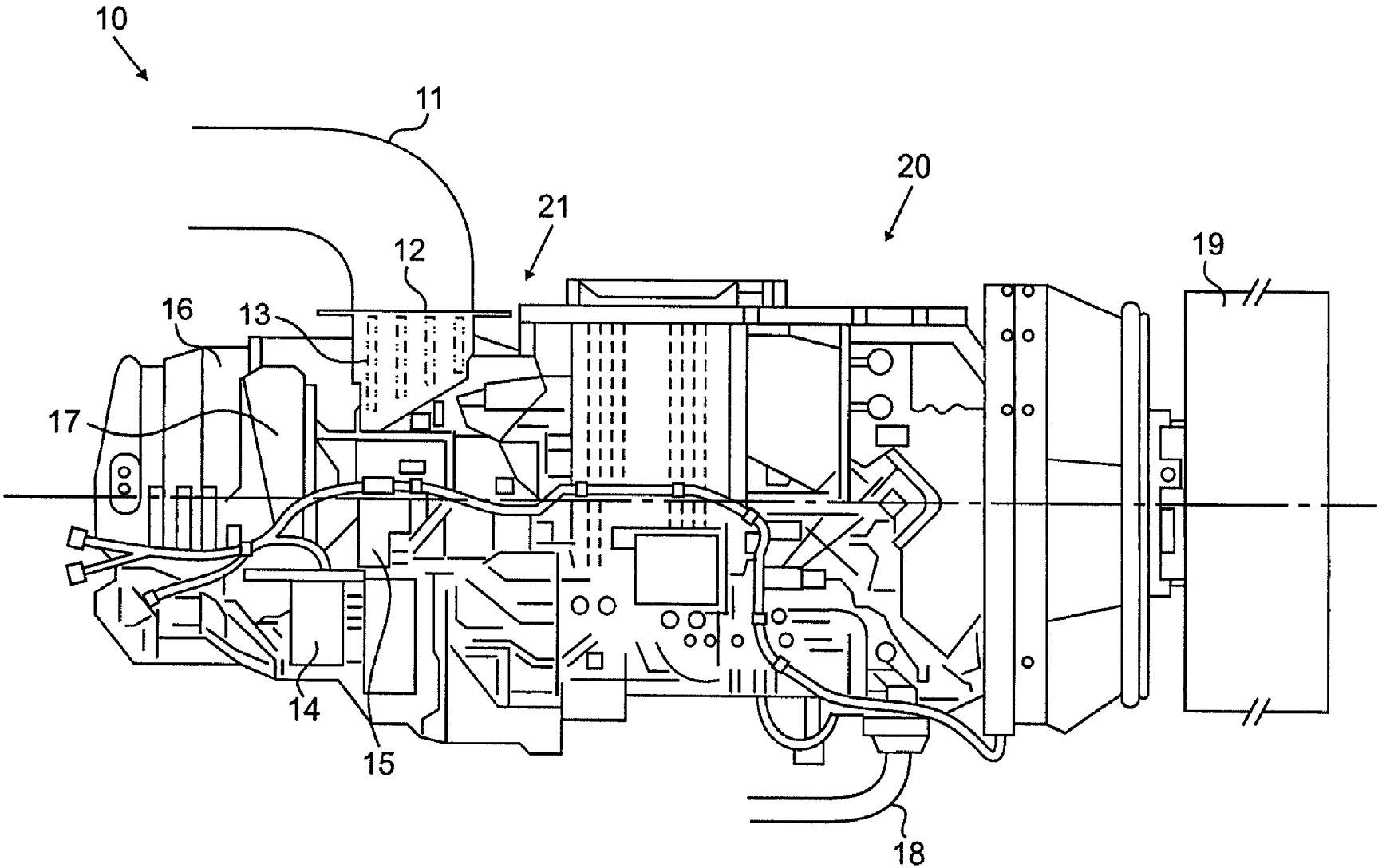
FIG. 1 is a side view illustrating one possible embodiment of a reduced-noise auxiliary power unit.

FIG. 1 is a side view illustrating one possible application of the system for reducing compressor noise, namely an auxiliary power unit (APU) 10. APU 10 comprises inlet air duct 11, inlet silencer 12 with baffles 13, start motor 14, gearbox 15, generator 16, fan 17, bleed air/pneumatic manifold 18, muffler 19 and engine core 20 with a rotary compressor 21. Many of these components are only briefly described below, as a detailed discussion of their features is unnecessary for an understanding of the present invention.

Inlet air duct 11 provides a path for airflow to engine core 20. Silencer 12 is disposed within inlet air duct 11, proximate compressor 21. Silencer 12 has baffles 13 (shown in phantom) to absorb and reduce noise related to operation of the compressor. In one embodiment silencer 12 is a turbine inlet silencer as described in Napier et al., U.S. Pat. No. 5,140,819 (issued Aug. 25, 1992) and U.S. Pat. No. 5,491,308 (issued Feb. 13, 1996).

Start motor 14 typically comprises an electric motor, and is utilized to start engine core 20. Start motor 14 is coupled to engine core 20 via gearbox 15. Gearbox 15 also couples engine core 20 to generator 16, which generates electrical energy from rotational energy supplied by the engine core. Gearbox 15 also delivers rotational energy to fan 17.

Generator 16 is representative of an electrical generator, a pair of electrical generators, or a number of generator systems. Similarly, fan 17 is representative of number of different elements, including, but not limited to, a fan, a hydraulic pump, a fuel pump, an oil pump, or a combination thereof.

In some embodiments, APU 10 utilizes bleed air/pneumatic air manifold 18. Bleed air/pneumatic air manifold 18 delivers compressed air from engine core 20 to a variety of systems including, but not limited to, an air starter motor for a main engine, an anti-icing system, a cargo hold heating system, a smoke detection system, a potable water pressurization system, a cabin air/environmental control system, and pneumatically pressurized components of the hydraulic system.

Muffler 19 attenuates exhaust noise. Muffler 19 typically comprises an outer can, an acoustic liner at an inner diameter flow path, and a series of baffles between the outer can and the acoustic liner. The liner and baffles absorb exhaust noise and alter its frequency make up. In some embodiments, muffler 19 is coupled to an eductor system to entrain cooling air flow through a dedicated APU compartment located in an aircraft tail cone.

In operation of APU 10, start motor 14 starts engine core 20 via coupling to gearbox 15. Engine core 20 powers generator 16, fan 17, and, in some embodiments, generates compressed air for bleed air/pneumatic manifold 18. Muffler 19 muffles noise from the exhaust of engine core 20, and inlet silencer 12 reduces noise from inlet 11.

Compressor 21 is configured to enhance noise reduction by shifting acoustic energy from the BPF to other frequencies. This has two effects. First, it reduces noise intensity at the BPF (specifically, it reduces acoustic energy in a ⅓-octave range spanning the BPF). This alters subjective response to the compressor noise, because the physiological effects of noise are frequency dependent. Second, in embodiments employing inlet silencer 12, the shifted acoustic energy is preferentially absorbed by the silencer, reducing total noise intensity as well.

Figure 2:
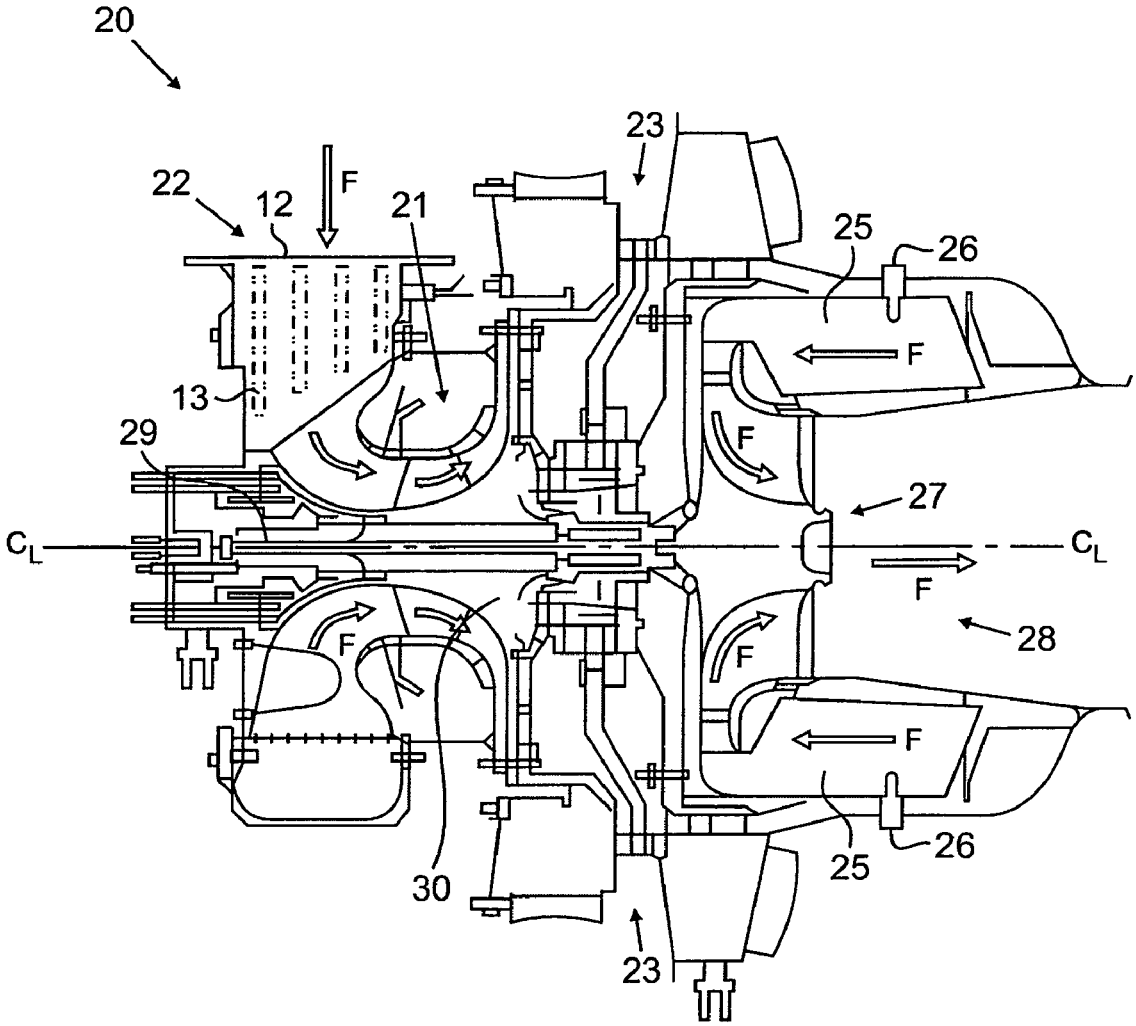
FIG. 2 is a cross-sectional side view of an engine core for the auxiliary power unit in FIG. 1, illustrating one possible embodiment of a reduced-noise compressor.

FIG. 2 is a cross-sectional side view of engine core 20 for APU 10, illustrating one possible embodiment of compressor 21. Engine core 20 comprises compressor 21, inlet 22, diffuser 23, combustor 25 with fuel nozzles 26, turbine 27, exhaust 28 and shaft 29.

Compressor 21, combustor 25, and turbine 27 are arranged in flow series about axial centerline $C_L$. Air enters compressor 21 via inlet 22 and inlet silencer 12 with baffles 13. The air is compressed by reduced-noise compressor 21, which provides pressurized air to diffuser 23. Diffuser 23 reduces the translational velocity of the compressed air, increasing its static pressure according to Bernouli's principle. Air from diffuser 23 is used to supercharge combustor 25 and is typically delivered to a pneumatic/bleed air system, which varies from embodiment to embodiment.

Fuel is injected into combustor 25 via fuel nozzles 26, where it is mixed with the compressed air from diffuser 23 to form a supercharged fuel/air mixture. In aviation applications the fuel is typically a military aviation fuel such as JP-5 or JP-8 (jet propulsion fuels designated MIL-PRF-5624S/NATO F-44 and MIL-DTL-83133/NATO F-34, respectively), or civil aviation fuels Jet A, Jet A-1 or JET B (ASTM D-1655 type A, A1 or B).

The fuel-air mixture is ignited to produce hot combustion gases, which drive turbine 27 and then vent through exhaust 28. Turbine 27 drives rotor 30 of reduced-noise compressor 21, typically utilizing a curvic coupling to shaft 29. Rotational energy is extracted from shaft 29 via a gearbox, and supplied to various generators, pumps and other accessory systems as described above.

In the embodiment of FIG. 2, combustor 25 is of an annular, reverse-flow configuration and both compressor 21 and turbine 27 exhibit a radial or centrifugal design. In this configuration, the working fluid (air and hot combustion gas) flows radially (inward) through inlet 22 and silencer 12, as indicated by flow arrows F. Flow continues axially to compressor 21, radially (outward) to diffuser 23, then follows diffuser 23 to combustor 25. Flow reverse at the combustor, entering turbine 27 radially (inwardly) and exiting axially via exhaust 28.

In one embodiment, engine core 20 powers an APU. Alternatively, engine core 20 powers a ground-based industrial gas turbine configured to generate electrical power, a turbofan or turbojet engine configured to generate thrust, or a land vehicle-based or marine vessel-based gas turbine engine configured to generate motive power. In some of these embodiments, the flow of working fluid is substantially axial through any or all of compressor 21, combustor 25 and turbine 27.

As compressor 21 rotates, the blades travel at transonic or supersonic speeds with respect to the working fluid. This results in a series of shock waves, which are generated at the blade passing frequency (BPF). As the shock waves propagate away from compressor 21, they disperse into a broad-spectrum noise pattern characterized by a "buzz saw" acoustic spectrum. Mistuning the blades of compressor 21 alters the buzz saw spectrum by enhancing the shift of acoustic energy out of the BPF tone, and redistributing it to multiple-tone harmonics of the shaft speed. In one embodiment the multiple tones lie preferentially below the BPF tone, but in general they fall both above and below the BPF tone.

In the absence of absorption or non-linear, dissipative effects, acoustic energy is conserved. The redistribution results in a decrease in tonal amplitudes (tonal intensities), particularly at the BPF, and an increase in multiple-tone amplitudes. In some embodiments the multiple-tone amplitudes are undesirable, because they represent "buzz saw" noise. In these embodiments, the system is configurable to be deployed with an inlet silencer that preferentially absorbs some of the multiple tones (that is, it absorbs acoustic energy that has been shifted away from the BPF, and redistributed to other frequencies). In these embodiments, there is net loss in total intensity. In other embodiments the tonal amplitudes are undesirable and the multiple-tone amplitudes are less undesirable. In these embodiments the benefit is inherent, even without preferential absorption.

Figure 3:
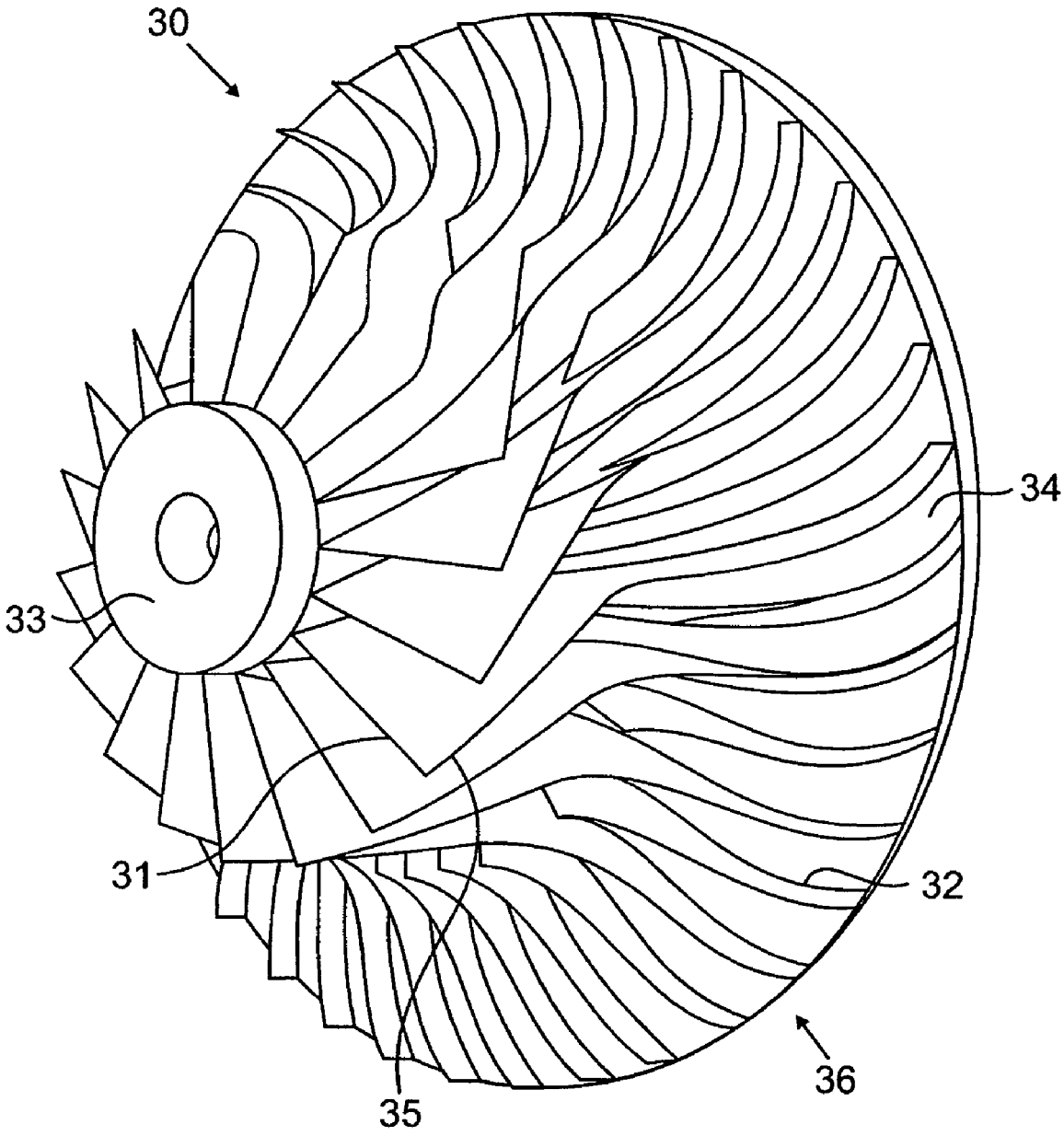
FIG. 3 is a perspective view of a reduced-noise rotor for the compressor in FIG. 2.

FIG. 3 is a perspective view of reduced-noise rotor 30 for compressor 21 of FIG. 2. Rotor 30 comprises inducer blades 31 and, in this embodiment, splitter blades 32. Inducer blades (hereafter, "blades") 31 and splitter blades (hereafter, "splitters") 32 are oriented radially around rotor hub 33 and disk 34.

Blades 31 extend radially from rotor hub 33 to blade tip 35, axially to frustoconical disk section 34, and then axially/radially along frustoconical disk section 34 to disk perimeter 36. Splitters 32 extend along disk 34 to perimeter 36 between blades 31.

In some embodiments, rotor 30 is a single-piece rotor in which blades 31, hub 33 and disk 34 are integrally formed as by a mechanical process a unitary structure. Some of these embodiments comprise splitters 32, and some do not. In other embodiments, blades 31 are detachably attached to rotor hub 33. Rotor 30 also has drum configurations, rather than frustoconical disk and hub configurations, as is typical of an axial-flow gas turbine engine for ground-based electrical power generation, or for a turbojet or turbofan engine. In these embodiments there are typically no splitters 32, and blades 31 are often arranged in a number of compressor or compressor stages ordered axially along a single rotor, or ordered along a number of nested rotor spools.

In the illustrative embodiment of FIG. 3, rotor 30 is a unitary structure with an arbitrarily defined overall diameter of about sixteen inches (approximately 40 cm). In this embodiment, blades 31 extend radially from about two inches (5 cm) off-axis at hub 33 (the proximal end), to about five and a half inches (14 cm) off-axis at blade tip 35 (the distal end). These dimensions are, however, merely representative, and in other embodiments they vary from these values.

Rotor 30 reduces compressor noise intensity by "mistuning" at least some of individual blades 31. Specifically, the blades as a group are characterized by a nominal blade geometry, but at least some of the blades differ from this nominal geometry by exhibiting substantial differences in pitch, sweep angle, lean angle, or cutback. These differences cause the blades to generate non-uniform shock waves that vary in strength and intensity, resulting in dispersive interference and shock merger in the initially straight inlet section feeding the compressor. Other non-linear effects, such as thermal dispersion/dissipation, can also occur.

These effects shift noise intensity away from the BPF, as described with respect to FIGS. 5A and 5B, below. This alters the subjective response to the compressor noise, because the response (that is, the physiological effect of the noise) is frequency dependent. In preferred embodiments, which are deployed with an absorptive element such as turbine inlet silencer 12 of FIG. 2, it also increases absorption and reduces total noise intensity.

Figure 4:
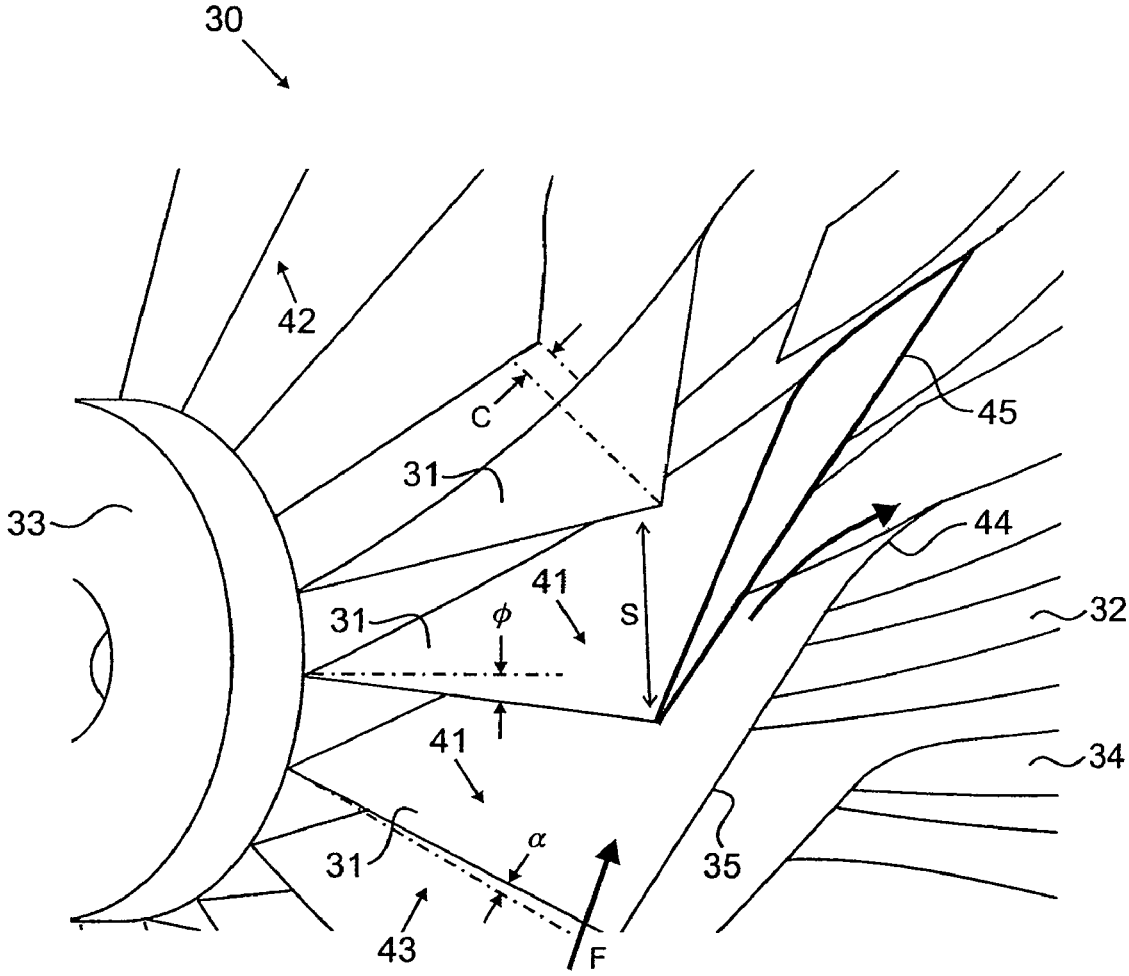
FIG. 4 is an enlarged perspective view of the rotor in FIG. 3, illustrating blade geometry.

FIG. 4 is an enlarged perspective view of rotor 30, illustrating the geometry of blades 31. Individual blades 31 comprises upper convex (suction) surface 41 and lower concave (pressure) surface 42.

Blades 31 are affixed to hub 33 of rotor 30, with leading edge 43 extending from hub 33 to blade tips 35. At blade tip 35, blades 31 extend from leading edge 43 to transition 44 and then along frustoconical disk 34 toward the disk perimeter (not shown; see FIG. 3, above). Splitters 32 extend along disk 34 between blades 31.

The particular configuration of blades 31 is characteristic of centrifugal compressor rotor 30, and does not conform to traditional isolated airfoil geometry. For example, individual blades 31 do not have traditional trailing edges. Instead, chord line 45, which defines the chord length, extends from leading edge 43 to approximately transition 44, where blades 31 begin to extend along disk 34.

Blades 31 are also characterized by approximately constant and relatively small thickness T, as measured between upper surface 41 and lower surface 42, with a substantially linear profile near leading edge 43 and increasing curvature downstream toward transition 44. Further, blades 31 are substantially asymmetric, and typically have a negative stagger angle (or setting angle) $\phi_s$, as defined between chord 45 and axis A.

Flow onto rotor 30 is substantially axial with respect to the compressor housing, but in the frame of the rapidly rotating blades incident flow F lies approximately along a tangent to camber line 46, so that the angle of attack is positive. The exit flow exhibits substantial deflection, and acquires a large radial component as proceeds along frustoconical disk 34.

Note that the geometries of blades 31 vary along leading edge 43, as described by functional descriptors such as blade twist, axial sweep, and taper, which relate blade parameters to radius. Relevant parameters are determined in the region of shock wave formation, which is typically proximate blade tip 35 (that is, extending outward from about 50% of the span, with increasing Mach velocity toward the distal region between 90% span and blade tip 35, which is at 100% span). In contrast to previous designs, at least some of blades 31 differ substantially from the nominal blade geometry in this region, reducing noise intensity as described above.

Specifically, at least some of blades 31 differ from the nominal geometry by greater than the manufacturing tolerance in at least one blade parameter. The manufacturing tolerance defines a range of substantially uniform blade geometries, which is the usual design goal. A three-sigma tolerance, for example, is defined by three times the standard deviation of a sample of blade parameters. A fixed tolerance, on the other hand, is defined by an engineering limit on the parameter.

Blades 31 contrast with previous designs, because least some of the blades substantially differ from the nominal geometry; that is, they intentionally fall outside the manufacturing tolerance. The tolerance is defined with respect to at least one blade parameter including, but not limited to, pitch, sweep angle, lean angle, and cutback. The differences between the nominal geometry and the mistuned blades are expressed in the region of shock wave (or Mach wave) formation, which is the region proximate blade tip 35 (that is, in excess of 50% span).

A substantial difference is determined with respect to the manufacturing tolerance; that is, it is at least larger than the manufacturing tolerance, and typically two to three times the manufacturing tolerance. In an exemplary embodiment, a substantial difference in sweep angle $\alpha$ (as measured in an axial direction, between the leading edge and a radius) is at least plus-or-minus two degrees (±2°), and is typically plus-or minus ten degrees (±10°). A substantial difference in lean angle $\phi$ (as measured in an azimuthal direction) is typically plus-or-minus two degrees (±2°), and typically plus-or-minus five degrees (±5°).

Differences in cutback C (as measured between adjacent leading edges in the axial direction) and pitch S (as measured in the azimuthal direction) arise both directly, due to explicit changes in the parameters, and indirectly, due to differences in twist, lean, stagger, and related blade parameters, particularly as expressed near the blade tips. Substantial differences in pitch S are at least two percent (2%), and are typically five percent (5%). Substantial differences in cutback C are at least plus-or-minus five percent (5%), and are typically plus-or-minus fifteen percent (15%).

Note that the mistuning of individual blade geometries is not arbitrary within these ranges. In contrast to previous techniques applied to more traditional blade geometries, and as distinct from subsonic blade applications, these differences reflect numerical analyses performed on specific configurations for blades 31, including the particularities of flow along rotor 30 and the details of shock wave formation proximate blade tips 35. Specifically, the modifications change the shock wave structure from a relatively uniform, periodic pressure field to a relatively non-uniform, aperiodic pressure field, reducing far-field noise intensity at the BPF while maintaining compressor performance.

Figure 5A:
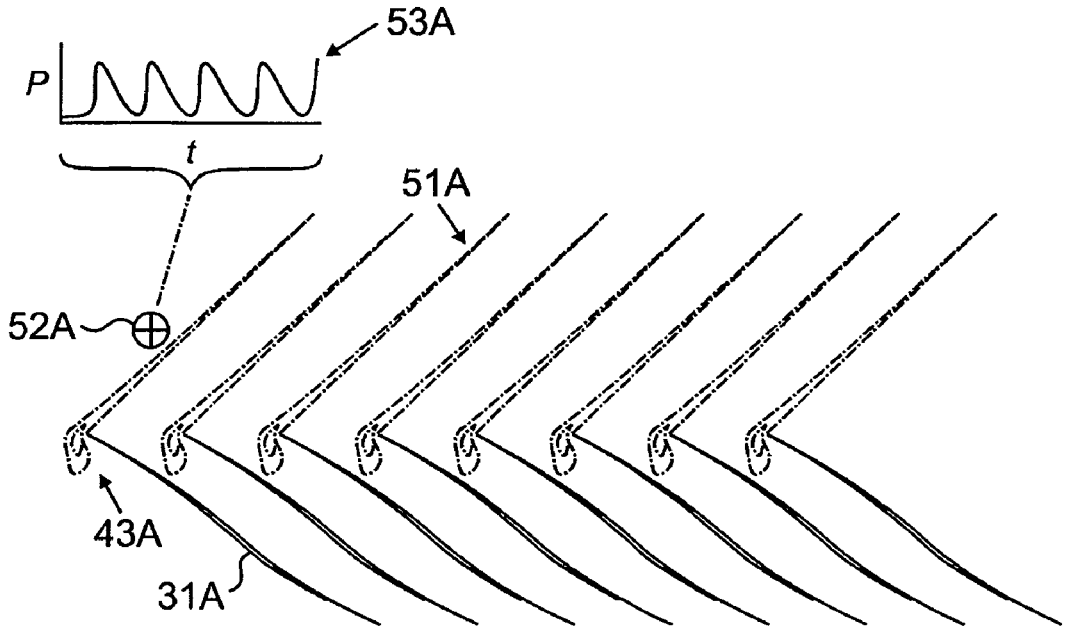
FIG. 5A (PRIOR ART)
FIG. 5A is a schematic illustration of uniform shock wave formation by a prior art compressor rotor.

FIG. 5A is a schematic illustration of uniform shock wave formation by a prior art compressor rotor. The prior art rotor has (uniform) prior art blades 31A. Blades 31A are shown in cross section, including leading edges 43A proximate the blade tips, and in "unwrapped" form. In this form the tangential direction of rotation is mapped to the horizontal axis, in order to provide a linear (representative) orientation for the blades, rather than the normal radial (physical) orientation.

As shown in FIG. 5A, prior art blades 31A are substantially uniform; that is, blades 31A do not differ from the nominal geometry by more than the manufacturing tolerance. Each blade 31A thus produces a substantially uniform shock wave (or Mach wave) 51A, as illustrated by uniform pressure-modulated waveform 53A at near-field test point 52A. FIG. 5A also includes a graphical interpretation of shocks inside the compressor passage, as illustrated by shock profiles extending below leading edges 43A.

Figure 5B:
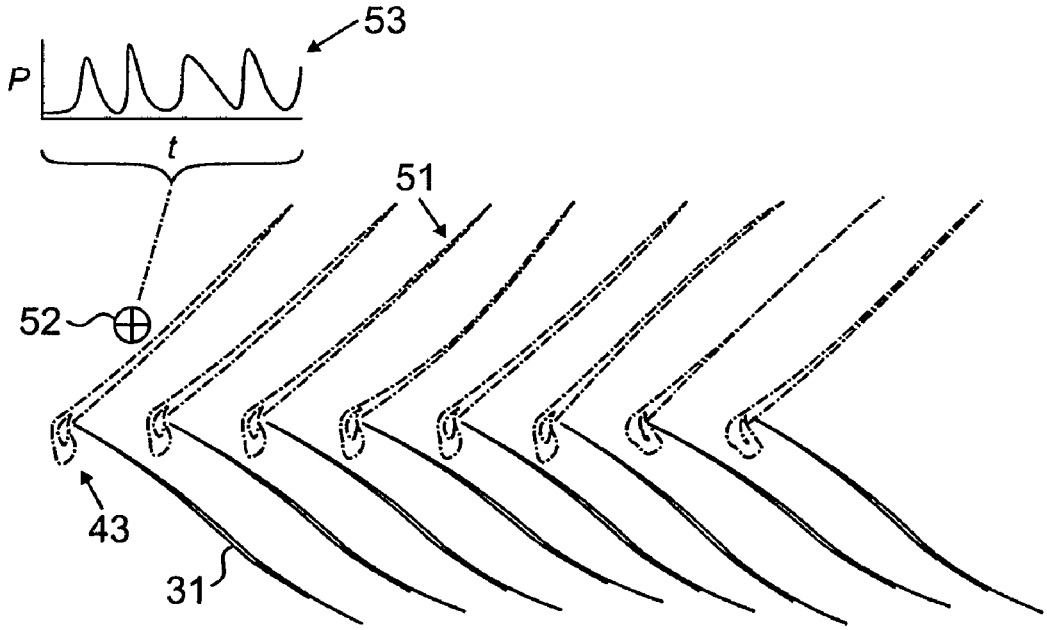
FIG. 5B is a schematic illustration of non-uniform shock wave formation by the reduced-noise compressor rotor in FIG. 3.

FIG. 5B is a schematic illustration of non-uniform shock wave formation by reduced-noise compressor rotor 30 of FIG. 3. Blades 31 of the reduced-noise rotor are also shown in unwrapped form, including leading edges 43 proximate the blade tips.

In contrast to previous designs, at least some of blades 31 are mistuned such that they significantly differ from the nominal blade geometry, by more than the manufacturing tolerance in at least one blade parameter. This causes shock waves 51 to exhibit a substantially non-uniform (aperiodic) pressure-modulated waveform 53 at near-field test point 52. This substantially alters the ultimate far-field acoustic energy spectrum and resulting noise intensity.

Shock waves (Mach waves) of different strengths have different supersonic velocities. Because blades 31 have individually variable geometries, shock waves 51 vary in strength, and thus travel at different speeds. The result is enhanced dispersive interference, shock merger and thermal dispersion, substantially altering the frequency spectrum of the compressor. Essentially, the mistuned blades reduce the pure tone at the BPF, and increase multiple tones at other shaft harmonics. In some embodiments, this shift creates "buzz saw" noise, and an inlet silencer is used to preferentially absorb the shifted acoustic energy. In other embodiments the shift has independent beneficial effects.

As blades 31 rotate, each acquires tangential (rotational) velocity v(r), which is a function of rotational speed Ω and radius r; namely:

$$v(r)=2\pi r\times\Omega\times(1\text{ Hz}/60\text{ rpm}). \quad [1]$$

Radius r is measured from the rotational axis. Tangential velocity v(r) is measured in the direction of rotation, which is tangential to radius r. Rotational speed (shaft speed) Ω is typically measured in rotations per minute (rpm), and the conversion factor (1 Hz/60 rpm) yields velocity v(r) in units of length per second.

In the representative 40 cm (0.40 m) rotor embodiment described above with respect to FIG. 3, blades 31 have radial dimension r extending from about 5 cm (0.05 m) at hub 33 to about 14 cm (0.14 m) at blade tip 35. For rotational speed Ω of approximately 30,000 rpm (500 Hz), tangential velocity v(r) is above one hundred meters per second proximate the hub, and above four hundred meters per second proximate the blade tip.

The tangential velocity should be compared to the speed of sound in air, which is substantially a linear function of temperature over typical compressor operating ranges. That is, $$c=331.3\text{ m/s}+\theta\times(0.6\text{ m/s}\cdot{}^\circ\text{ C.}), \quad [2]$$

where c is the speed of sound and θ is the temperature in degrees Celsius. According to Eq. 2, the speed of sound varies from just under 300 m/s at −60° C. (approximately −70° F., typical for commercial aircraft at cruising altitude) to about 350 m/s at 40° C. (corresponding to quite warm operating conditions, with ground temperatures over 100° F.).

Under these conditions, leading edges 43 of blades 31 span a range of subsonic, transonic, and supersonic velocities. In the subsonic range, flow along the blade remains below the speed of sound, even at the tip. At transonic speeds, both supersonic and subsonic flows occur in different localized regions of the blade. In the supersonic region, flow is supersonic all along the relevant portions of the blade.

Supersonic flow along the blade tip generates shock waves (or Mach waves), which propagate past near-field observation point 52 at the blade passing frequency (BPF):

$$f_{bp}=N_b\times\Omega\times(1\text{ Hz}/60\text{ rpm}), \quad [3]$$

where $f_b$ is the BPF, $N_b$ is the number of blades, Ω is the rotational speed (or shaft speed) in rpm, and the conversion factor (60 Hz/rpm) yields $f_b$ in hertz (Hz, or cycles per second). Essentially, the BPF is a harmonic of the shaft speed, with the harmonic number (the engine order) defined by the number of blades. For blade number $N_b$ equal to twenty-four, for example, the BPF is at the twenty-fourth engine order (that is, twenty-four times the shaft speed). For shaft speeds Ω in excess of 30,000 rpm, the BPF exceeds 12,000 Hz. Higher-order harmonics (higher engine orders) lie above the BPF, and lower-order harmonics (lower engine orders) lie below the BPF.

Because at least some of blades 31 differ from the nominal geometry, Mach waveform 53 is non-uniform at near-field observation point 52. This contrasts with substantially uniform waveform 53A, generated by prior art blades 31A. As non-uniform shock waves 51 propagate past observation point 52, they undergo enhanced dispersive interference, merger, and thermal dispersion.

Specifically, faster shocks advance relative to slower shocks, and slower shocks retreat relative to stronger shocks. As the waveforms propagate away from the rotor face, some shocks interfere or merge, reducing the number of discrete shock waves. Thermal dispersion reduces the total acoustic energy, and the discrete, periodic shock waves disperse, or spread out in space. The result is an evolution from a series of relatively strong, discrete, periodic shocks into a series of weaker, aperiodic shocks characterized by a broad multiple-tone acoustic spectrum, which is referred to as "buzz saw" noise.

In preferred embodiments, in which an inlet silencer is deployed, the region of classical 2-D shock merger is typically limited to the duct region between leading edges 43 of blades 31, from which the shock emerge, and the silencer. Beyond this region the acoustic field becomes reverberant, 3-D flow field modeling is required, and the particulars of compressor geometry have less effect on propagation. In other embodiments, the region of classical 2-D shock merger varies in extent, but the effect typically remains greatest in the near field, close to the rotor face.

The usual goal for rotor blades is to reduce non-uniformities, resulting in a uniform shock wave structure that reduces frequency shifts (multiple-tone shaft speed harmonics) and concentrates acoustic energy at the BPF. Mistuned blades 31, in contrast, enhance frequency shifting, in direct contradiction to previous approaches. This reduces sound intensity at the BPF, and yields a substantially different far-field frequency spectrum. In various embodiments the advantages are due both to inherent engineering considerations regarding the BPF (tonal) noise intensity, vis-a-vis broad-band (multiple-tone) noise intensity, and due to the system's capability to be deployed with an inlet silencer.

Figure 6:
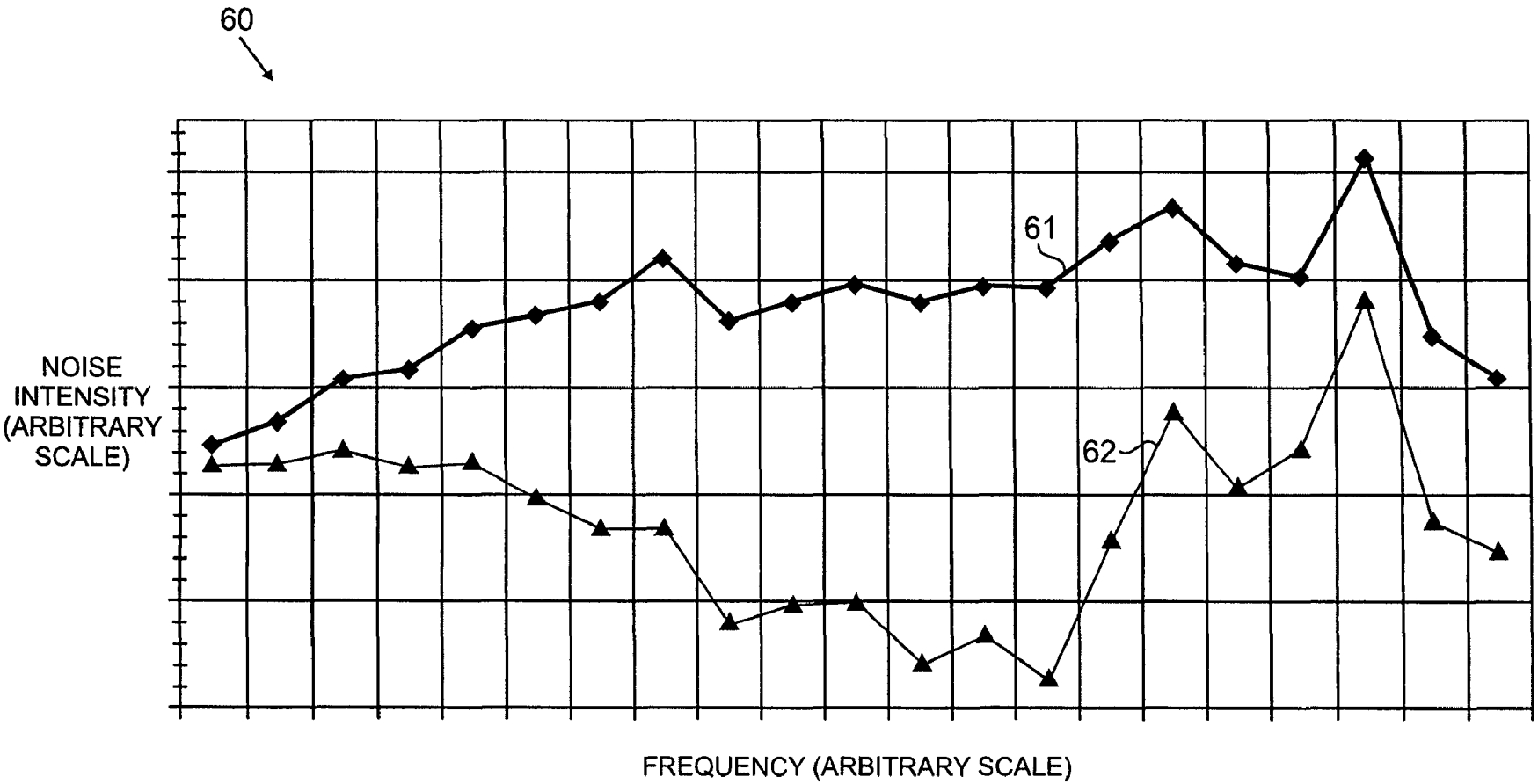
FIG. 6 is a noise intensity plot illustrating the effect of an inlet silencer on noise intensity.

FIG. 6 is a noise intensity plot (graph 60) illustrating the effect of an inlet silencer on noise intensity. Graph 60 plots models of raw source noise spectrum 61 and downfield sound spectrum 62 as a function of frequency, for ⅓-octave frequency bands. The noise intensity is typically measured on the A-weighted scale, but spectra 61 and 62 are representative of a number of different rotor and silencer embodiments, and the vertical axis has arbitrary absolute scale.

Representative sound spectrum 62 is modeled at a far-field observation point, after shock wave propagation through a turbine inlet silencer. Representative raw noise spectrum 61 is also modeled at a far-field point. Both spectrum 61 and spectrum 62 illustrate the shift of noise intensity away from the BPF. The shift is predominantly toward lower frequencies (lower engine orders, or lower-order harmonics), but some energy is shifted above the BPF as well. Mistuning of the rotor blades enhances this shift with respect to previous designs, as described above.

Spectrum 62 also illustrates the advantage of the system's deployability with a turbine inlet silencer. The silencer preferentially absorbs acoustic energy in the range of 2,000-5,000 Hz (2-5 kHz), so that acoustic energy redistributed away from the BPF is preferentially absorbed, reducing the total sound intensity (as determined, for example, by the overall sound pressure level, or OASPL, weighted over all resolved audio frequencies). Mistuning the rotor blades enhances the acoustic shift, further decreasing the total intensity, by at least three decibels (3 dB) on the A-weighed scale (3 dBA).

This benefits are characterized under a number of different noise assessment standards, including the effective perceived noise level (EPNL), the internationally standardized A and D weighting curves, and standard equivalent A-weighting. These measures emphasize subjective response to noise in an enhanced frequency range lying between approximately 500 Hz (alternatively, 1 kHz) and approximately 4 kHz (alternatively, 5 kHz). This is the range in which the physiological effects of the noise, including both subjective indicators such as annoyance and objective indicators such as occupational hazard metrics, are typically greater than in other frequency ranges.

The advantages of mistuning are not limited to a particular rotor and silencer configuration, however, nor to a particular BPF range. The degree of mistuning can be tailored to wide range of compressor geometries and applications, both with and without silencer structures. In some of these embodiments the shift of acoustic energy away from the BPF has benefits that depend upon vibrational and structural characteristics, high frequency/ultrasonic noise emissions, or other engineering considerations that are completely independent of human response-based metrics like A-weighting and the OASPL.

Figure 7:
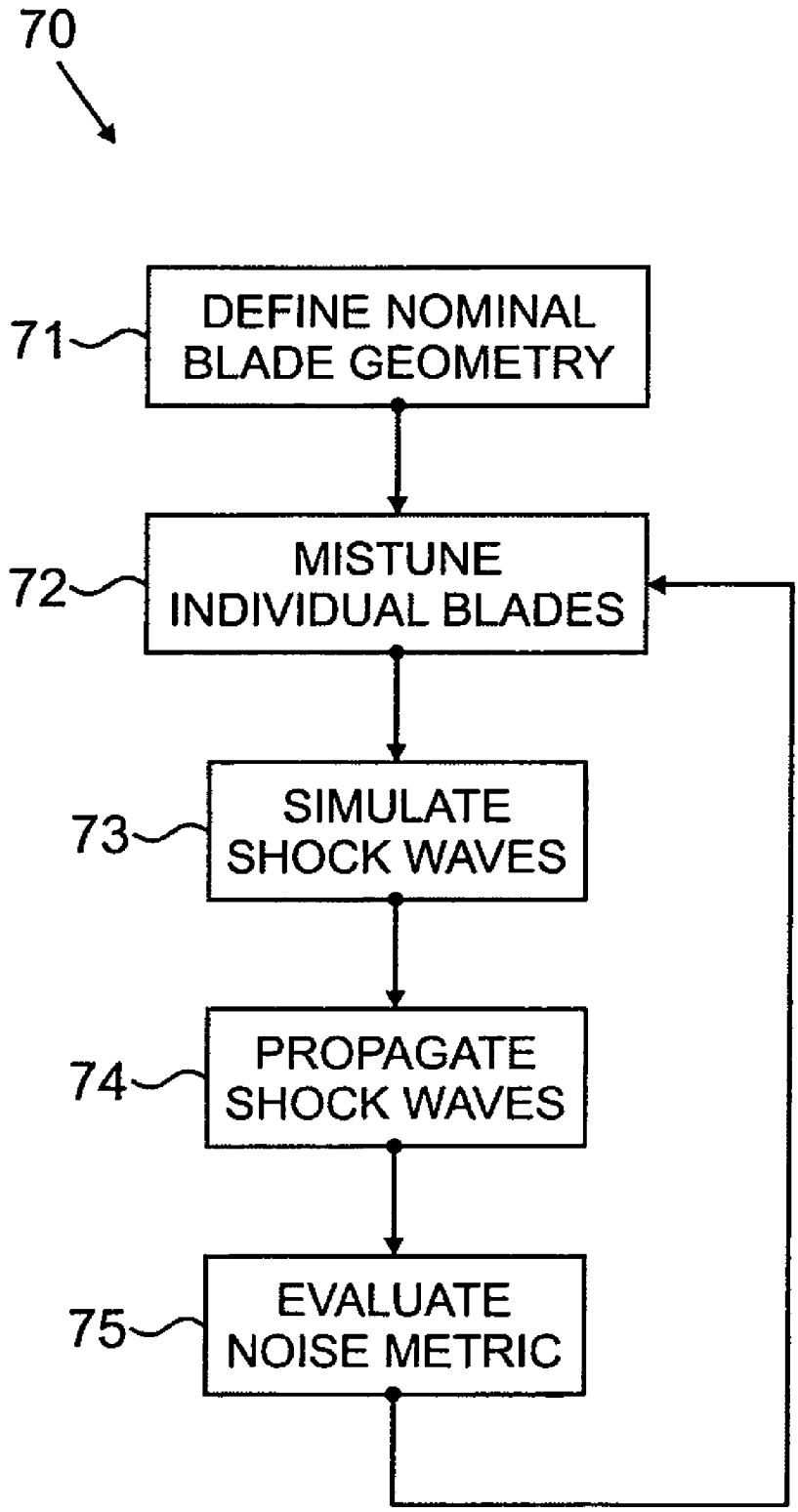
FIG. 7 is a flow chart illustrating a method for reducing noise intensity from the compressor in FIG. 2.

FIG. 7 is a flow chart illustrating method 70 for making a compressor that shifts acoustic energy away from the BPF. Method 70 comprises defining a nominal blade geometry (step 71), mistuning individual blades (step 72), simulating shock waves (step 73), propagating the shock waves (step 74), and evaluating a noise metric (step 75).

Defining nominal blade geometry (step 71) comprises defining a number of blade parameters including, but not limited to, stagger angle, pitch, camber, camber angle, sweep, maximum camber point, blade thickness, maximum thickness point, chord length, blade height, aspect ratio, hub-to-tip ratio, twist, lean and taper. In a preferred embodiment, the nominal blade geometry is defined for a rotor having a hub and a frustoconical disk configuration, as described with respect to FIG. 3, above, either with or without splitters 32.

Mistuning individual blades (step 72) comprises changing (mistuning) at least one blade parameter for at least some of the blades, such that the blades vary from the nominal geometry by greater than the manufacturing tolerance in the parameter. Typically, angular parameters such as sweep angle and lean angle are mistuned by at least plus-or-minus two degrees (±2°), and dimensional parameters such as pitch and cutback are mistuned by at least plus-or-minus two percent to five percent (2-5%).

Mistuning is not arbitrary within these ranges, but is precisely determined in order to modify shock wave formation along the blades, reduce noise intensity, and maintain compressor performance. Mistuning reflects the particular blade configuration, rotational characteristics, and flow pattern of the rotary compressor, as described above with respect to FIGS. 4, 5A and 5B.

In a preferred embodiment, mistuning (step 72) is also performed such that the blades are symmetrically balanced. That is, the individual geometries of symmetrically located blades are matched, so the rotor remains balanced about its rotational axis. Symmetrically balanced blades are typically opposite pairs, but in some embodiments they comprise a symmetric triplet oriented at one hundred and twenty degrees, or another symmetric combination.

For single-piece rotors, symmetric balancing is accomplished by manufacturing a single-piece rotor with symmetrically balanced blades, or by machining symmetrically balanced blade modifications onto a single-piece rotor. Alternatively, balanced detachable blades are affixed to symmetric locations on a multi-piece rotor assembly.

Symmetric balancing reduces rotor vibrations that would otherwise occur when individual blades were mistuned, offsetting rotor balance. Alternatively, blade-to-blade variations can be constrained so that the overall asymmetry of the rotor is limited, with a similar effect on vibration reduction.

Simulating shock waves (step 73) comprises simulating shock or Mach waves generated via the interaction of the blades with a working fluid flow. The shock waves typically comprise supersonic shock waves generated at the blade tips, but in some embodiments comprise a combination of supersonic and transonic shock waves generated along different sections of the blade.

Propagating the shock waves (step 74) comprises propagating the shock waveforms from the rotor face to an observation point. In preferred embodiments, the region of greatest non-linear effect—including shock merger, dispersive interference, and thermal dissipation—is between the rotor face and an inlet silencer. In these embodiments, inlet walls and other guide structures define boundary conditions for further propagation, and baffles and other absorptive structures absorb acoustic energy as a function of frequency, preferentially in an enhanced response range.

Propagation (step 74) is also performed in a quasi-free field region, in which the shock and acoustic waves propagate substantially freely, beyond any inlet, silencer, or fuselage structures, to a far-field observation point. In the quasi-free field region the effects of mistuned rotor blades are substantially reduced with respect to the near-field region, proximate the rotor face, where the non-linear effects are most important.

In some embodiments waveform propagation (step 74) comprises mathematical or analytical waveform propagation, and in other embodiments propagation comprises a combination of mathematical techniques and physical measurements, as obtained at various test points. In these embodiments the test points include, but are not limited to, near-field points proximate the compressor, where there is a substantially Mach or shock wave structure, points within an inlet or inlet silencer, and far-field test points in a quasi-free field region.

Evaluating a noise metric (step 75) comprises modeling the noise intensity generated by the shock waveforms, after propagation to the observation point. Typically, the observation point is a far-field test point located at a physical structure such as an aircraft door, or at a standardized distance from the compressor or compressor inlet.

Evaluation (step 75) is a function of frequency and engine order. In some embodiments, evaluation comprises mathematical modeling of the noise intensity at the observations points. In other embodiments, evaluation comprises both mathematical modeling and physical measurement of the noise intensity, as sampled at various test points.

Method 70 is typically performed iteratively, allowing the degree of mistuning to be tailored to a particular compressor application. Generally, the sound metric utilizes a decibel (dB) scale, typically with A-scale frequency weighting (dBA). The reduction is determined either via an integrated noise assessment such as the overall sound pressure level (OASPL), the effective perceived noise level (EPNL), or equivalent A-weighting.

In preferred embodiments, deployable with an inlet silencer, method 70 reduces sound intensity by a factor of two or more (that is, by three decibels or more), according to a human-response based metric as described above. In other embodiments the reduction is determined according to an independent metric, which is weighted based upon engineering considerations, or, alternatively, restricted to a ⅓-octave band covering a particular frequency such as the BPF.

Although the present invention has been described with reference to preferred embodiments, the terminology used is for the purposes of description, not limitation. Workers skilled in the art will recognize that changes may be made in form and detail without departing from the spirit and scope of the invention.

The invention claimed is:

1. A system for reducing compressor noise, the system comprising:

a compressor for generating compressed air, the compressor comprising a plurality of blades, wherein at least some of the blades are mistuned with respect to a nominal geometry; and an inlet silencer disposed in an upstream flow direction from the compressor, for absorbing acoustic energy;

wherein the mistuned blades differ from the nominal geometry by at least two degrees (2°) in a sweep angle.

2. The system of claim 1, wherein the mistuned blades reduce noise intensity by shifting acoustic energy to a frequency that is preferentially absorbed by the inlet silencer.

3. The system of claim 1, wherein the noise intensity is reduced by a substantial amount with respect to a compressor in which the blades are not mistuned.

4. The system of claim 3, wherein the noise intensity is reduced by a factor of two or more.

5. The system of claim 3, wherein the noise intensity is reduced by three decibels (3 dB) or more.

6. The system of claim 1, wherein the mistuned blades differ from the nominal geometry by at least two degrees (2°) in a lean angle.

7. The system of claim 1, wherein the mistuned blades differ from the nominal geometry by at least two percent (2%) in a pitch.

8. The system of claim 1, wherein the mistuned blades differ from the nominal geometry by at least five percent (5%) in a cutback.

9. A gas turbine engine comprising:

a turbine for generating rotational energy from combustion gas;

a combustor for generating the combustion gas from fuel and compressed air;

a compressor for generating the compressed air from the rotational energy, the compressor comprising:

a plurality of blades, wherein at least some of the blades are mistuned by greater than a manufacturing tolerance in a blade parameter; and a rotor for rotating the blades at a blade passing frequency;

wherein the blade parameter is one of a pitch or a cutback, and differs from a nominal geometry by five percent (5%) or more.

10. The gas turbine engine of claim 9, wherein the rotor is a centrifugal compressor rotor.

11. The gas turbine engine of claim 9, wherein the gas turbine engine is an auxiliary power unit.

12. The auxiliary power unit of claim 11, wherein the mistuned blades shift acoustic energy from the blade passing frequency to a frequency that is preferentially absorbed by an inlet silencer.

13. The auxiliary power unit of claim 11, wherein a total noise intensity of the auxiliary power unit is reduced by three decibels (3 dB) or more.

14. A compressor rotor comprising:

a plurality of blades having a nominal geometry characterized by a blade parameter, and producing shock waves at a blade passing frequency;

wherein at least some of the blades differ from the nominal geometry by more than a manufacturing tolerance in the blade parameter;

wherein the blade parameter is one of a pitch or a cutback, and differs from the nominal geometry by five percent (5%) or more.

15. The compressor rotor of claim 14, wherein the blades that differ from the nominal geometry shift acoustic energy away from the blade passing frequency, reducing noise intensity at the blade passing frequency by at least three decibels (3 dB).

16. The compressor rotor of claim 14, wherein the blade parameter is one of a sweep angle or a lean angle, and differs from the nominal geometry by two degrees (2°) or more.

17. The compressor rotor of claim 14, wherein the compressor rotor is a centrifugal compressor rotor.

18. The compressor rotor of claim 17, further comprising splitters disposed between the blades.

19. A system for reducing compressor noise, the system comprising:

a compressor for generating compressed air, the compressor comprising a plurality of blades, wherein at least some of the blades are mistuned with respect to a nominal geometry; and an inlet silencer disposed in an upstream flow direction from the compressor, for absorbing acoustic energy;

wherein the mistuned blades differ from the nominal geometry by at least two degrees (2°) in a lean angle.

20. A system for reducing compressor noise, the system comprising:

a compressor for generating compressed air, the compressor comprising a plurality of blades, wherein at least some of the blades are mistuned with respect to a nominal geometry; and an inlet silencer disposed in an upstream flow direction from the compressor, for absorbing acoustic energy;

wherein the mistuned blades differ from the nominal geometry by at least five percent (5%) in a cutback.

21. A gas turbine engine comprising:

a turbine for generating rotational energy from combustion gas;

a combustor for generating the combustion gas from fuel and compressed air;

a compressor for generating the compressed air from the rotational energy, the compressor comprising:

a plurality of blades, wherein at least some of the blades are mistuned by greater than a manufacturing tolerance in a blade parameter; and a rotor for rotating the blades at a blade passing frequency;

wherein the blade parameter is one of a sweep angle or a lean angle, and differs from a nominal geometry by two degrees (2°) or more.

* * * * *